United States Patent [19]

Wang

[11] Patent Number: 5,012,600

[45] Date of Patent: May 7, 1991

[54] FRAME FIXATION STRUCTURE

[76] Inventor: Thomas T. M. Wang, No. 1, Sublane 10, Lane 22, Kuang Fu S. Road, Taipei, Taiwan

[21] Appl. No.: 388,886

[22] Filed: Aug. 3, 1989

[51] Int. Cl.[5] ..... A47G 1/06; G09F 1/12

[52] U.S. Cl. ..... 40/152; 40/157; 24/176

[58] Field of Search ..... 40/152, 152.1, 40/152.2, 156–157, 642, 661; 24/563, 545, 546, 155, 154, 176, 482, 481, 296

[56] References Cited

U.S. PATENT DOCUMENTS

| | | | |
|---|---|---|---|
| 186,927 | 2/1877 | Dulin | 24/17 B |
| 340,238 | 4/1886 | Palmer | 24/17 B |
| 656,342 | 8/1900 | Carlton | 40/155 |
| 1,052,906 | 2/1913 | Ellis | 24/18 |

FOREIGN PATENT DOCUMENTS

| | | | |
|---|---|---|---|
| 529291 | 7/1931 | Fed. Rep. of Germany | 24/176 |
| 5898 | of 1887 | United Kingdom | 24/176 |
| 2090131 | 7/1982 | United Kingdom | 40/152 |
| 8723310 | 5/1988 | United Kingdom | 40/152 |

*Primary Examiner*—Peter R. Brown
*Assistant Examiner*—James M. Gardner
*Attorney, Agent, or Firm*—Lowe, Price, LeBlanc, Becker & Shur

[57] ABSTRACT

A frame fixation structure includes a transparent front board connected with a back board to clamp up pictures or a clock or desk sets therebetween. According to the present invention, two fastening methods are adopted, one is to set a pair of clamping means in the grooves between the front and back boards at two diagonal corners, while the other is to insert two rivet means through the two pair of symmetric holes respectively made on the front and back boards at two diagonal corners, and mount an elastic element (rubber band or the like) on the pair of rivet means to firmly retain the front and back boards together.

3 Claims, 3 Drawing Sheets

FRAME FIXATION STRUCTURE

BACKGROUND OF THE INVENTION

Regular photo frame or clock frame or desk sets is having a transparent glass mounted on a frame structure with a pressure plate stopped at the back side against the front transparent glass for setting therebetween of pictures or clock. When the front transparent glass and the back pressure plate are connected with pictures clamped therebetween. a plurality of movably fixing elements which are made on the frame structure are respectively turned inward to firmly retain the pressure plate and the transparent glass with the frame structure. At the present time, regular photo frames are normally made of acrylic material which makes the structure more attractive. However, the fixation of the frame structure still remains unchanged, that is, movable fixing elements are still commonly used. These conventional frame structures are not very practical in use because of the following drawbacks:

(1) Complicated manufacturing process: The manufacturing process is complicated because one and more stands are required.

(2) Inconvenient to operation: It is very inconvenient to fix stands onto the pressure plate.

(3) Expensive. Because the manufacturing process is complicated, the manufacturing cost can not be reduced.

The present invention is to provide a frame fixation structure having numerous advantages including:

(1) Simple structure.

(2) Convenient in use.

(3) Inexpensive to manufacture.

(4) Durable and position changeable.

SUMMARY OF THE INVENTION

The present invention is to provide a frame fixation structure and more particularly to a photo frame or clock frame structure or desk sets which is including a front transparent board connected with a back board to clamp up pictures or a clock therebetween, wherein the front and back boards are firmly retained together by means of a pair of clamping means which are respectively inserted into the grooves of the front and back boards at two diagonal corners or, by means of a pair of rivet means which are respectively inserted into the holes of the boards at two diagonal corners with an elastic element mounted thereon to fasten up the structure.

DETAILED DESCRIPTION OF THE PREFERRED EMBODIMENTS

Figure 1:
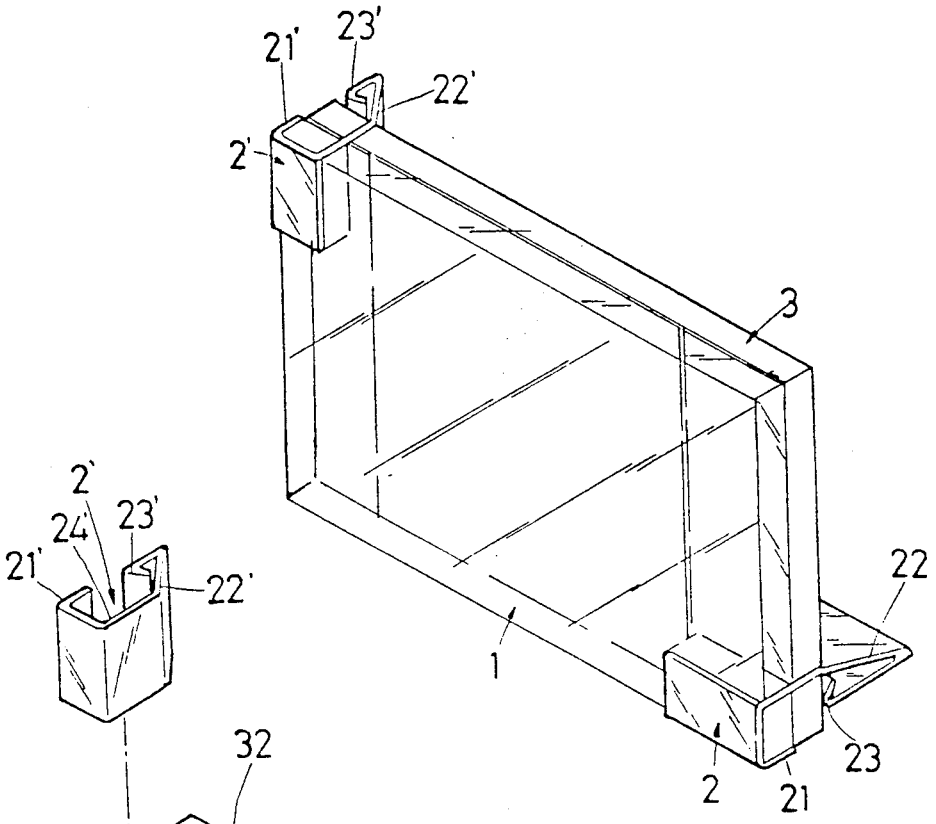
FIG. 1 is a perspective view of the first embodiment of the present invention.
Figure 2:
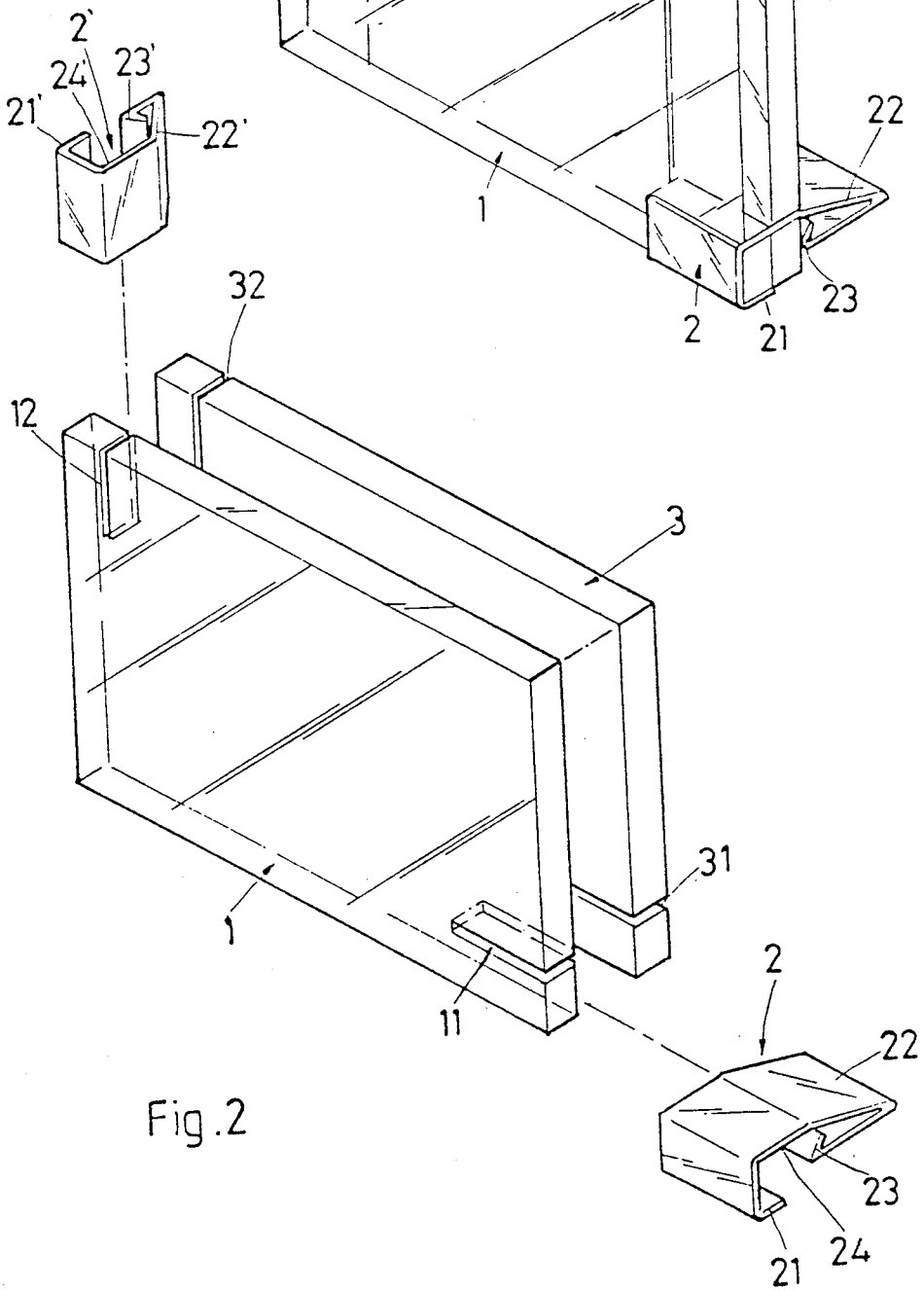
FIG. 2 is a perspective fragmentary view of the said first embodiment.
Figure 3:
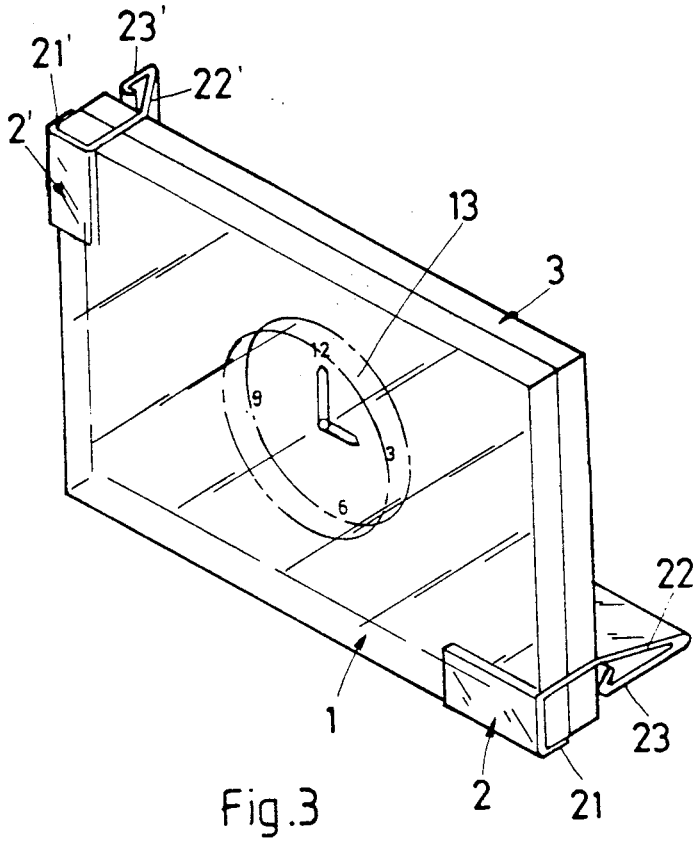
FIG. 3 is a perspective view of a clock frame constructed according to the said first embodiment.

According to the present invention, there are two fixation methods of which one is to make use of clamping means, and the other is to make use of elastic fastening element. With reference to FIG. 1, the frame is comprised of two transparent boards (1) and (3) attached together with two detachable clamping means (2) and (2)′ respectively connected thereto at two diagonal corners. With reference to FIG. 2, the clamping means (2) and (2)′ each is respectively made by means of integral shape forming process, having an L-shaped portion (21) or (21)′ to set in the grooves (11) and (31) or the grooves (12) and (32) of the boards (1) and (3), a bevel clamping portion (22) or (22)′ integrally connected with the L-shaped portion (21) or (21)′, and a supporting portion (23) or (23)′ integrally connected with the bevel clamping portion (22) or (22)′ and properly set to match with the L-shaped portion (21) or (21)′ so as to define a space (24) or (24)′ therebetween, wherein the space (24) or (24)′ is slightly narrower than the total thickness of the two boards (1) and (3) such that when the clamping means (2) or (2)′ is set in the grooves (11) and (31) or the grooves (12) and (32), the supporting portion (23) or (23)′ becomes tightly stopped against the board (3) to let the two transparent boards (1) and (3) be firmly retained together. With reference to FIG. 3, a slot (13) is symmetrically made on the two transparent boards (1) and (3) for setting therein of a picture or clock to form into a deck photo frame or clock frame.

Figure 4:
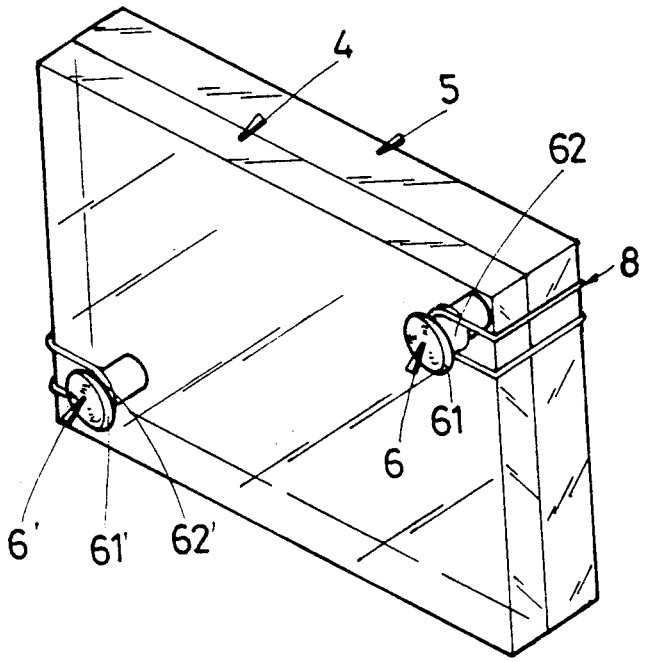
FIG. 4 is a perspective view of the second embodiment of the present invention.
Figure 5:
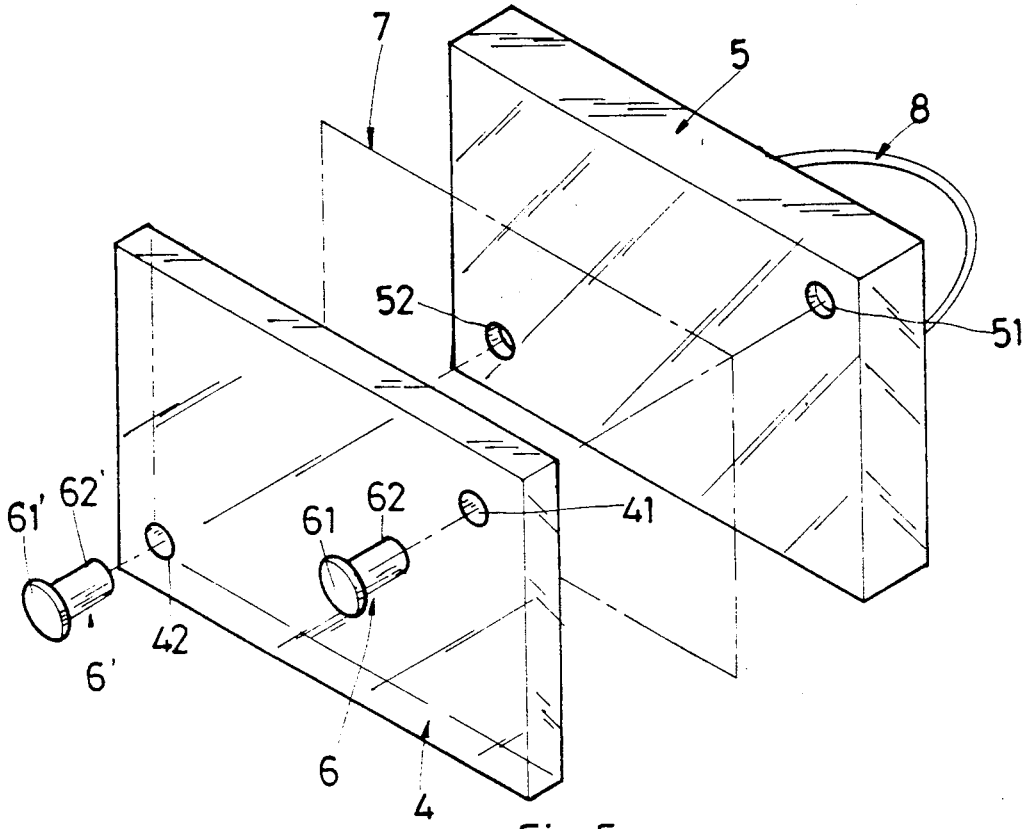
FIG. 5 is an exploded view of the said second embodiment.
Figure 6:
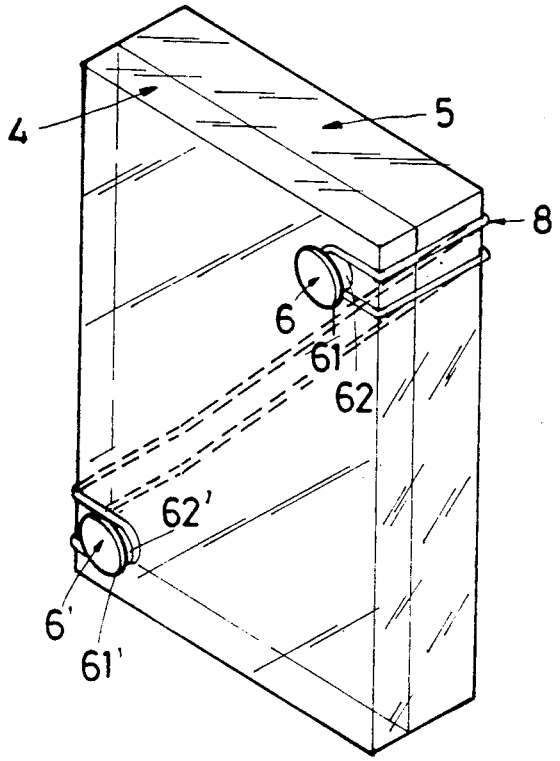
FIG. 6 is another perspective view of the said second embodiment.

With reference to FIGS. 4 and 5, the frame is made of two acrylic boards (4) and (5) firmly connected together. The two acrylic boards (4) and (5) are having holes (41) and (42), and holes (51) and (52) respectively made on two diagonal corners, wherein the holes (41) and (51) and the holes (42) and (52) are respectively aligned for setting therein of rivet means (6) and (6)′ respectively. The rivet means (6) and (6)′ each is including a head (61) or (61)′ with a rod portion (62) or (62)′ integrally connected thereto. The rod portion (62) or (62) of the rivet means (6) or (6)′ is arranged in size slightly smaller than the holes (41) and (42) or the holes (51) and (52). When a picture (7) is clamped between the two acrylic boards (4) and (5), the rod portions (62) and (62)′ of the rivet means (6) and (6)′ are respectively set in the holes (41) and (51) and the holes (42) and (52) respectively, with the heads (61) and (61)′ exposed outside. An elastic fastening element (8) (for example, rubber band) is mounted on the rivet means (6) and (6)′ at the connecting portions between the head portions (61) and (61)′ and the rod portions (62) and (62)′ to firmly retain the two acrylic boards (4) and (5) together. The frame thus formed can be transversely positioned on a desk. With reference to FIG. 6, the frame may be vertically positioned by means of changing the mounting position of the elastic element (8) on the rivet means (6) and (6)′ to fit for vertical display of picture. As an alternate form, the rivet means (6) and (6)′ may be integrally made on the front acrylic board (4) with rod portions (62) and (62) protruding outward for insertion into the holes (51) and (52) of the back acrylic board (5) respectively to let both front and back acrylic boards (4) and (5) be firmly retained together.

I claim:

1. A frame structure comprising:

a front transparent plate and a rear plate having holes respectively at two diagonal corners of each plate, each hole in said front plate being aligned with a hole in said rear plate;

a pair of rivets, each having a head and a rod portion, one rivet extending through each aligned hole from the front plate to the rear plate with each head portion being adjacent but spaced away from said front plate;

an elastic band connecting said rivets and extending around the rod portion thereof between the head portion and said front plate and extending therefrom behind said back plate whereby said structure is assembled.

2. The structure of claim 1 wherein said rivets are slidably received in the aligned holes and the head portions are larger than the diameter of the holes.

3. A frame structure comprising:

a front transparent plate and a rear plate having holes respectively at two diagonal corners of said rear plate;

a pair or rivets, each having a head and a rod portion disposed at corners of said front plate in alignment with the holes in said rear plate each rivet being integral with said front plate with each head portion being adjacent but spaced away from said front plate and each rod portion extending through an aligned hole in said rear plate;

an elastic band connecting said rivets and extending around the rod portion thereof between the head portion said front plate and extending therebehind said back plate whereby said structure is assembled.

* * * * *